US010388474B2

(12) United States Patent
Wu

(10) Patent No.: US 10,388,474 B2
(45) Date of Patent: Aug. 20, 2019

(54) KEYBOARD SWITCH

(71) Applicant: DONGGUAN CITY KAIHUA ELECTRONICS CO., LTD, Dongguan, Guangdong (CN)

(72) Inventor: Fuxi Wu, Guangdong (CN)

(73) Assignee: DONGGUAN CITY KAIHUA ELECTRONICS CO., LTD, Dongguan, Guangdong (CN)

( * ) Notice: Subject to any disclaimer, the term of this patent is extended or adjusted under 35 U.S.C. 154(b) by 0 days.

(21) Appl. No.: 15/747,926

(22) PCT Filed: Jul. 21, 2016

(86) PCT No.: PCT/CN2016/090862
§ 371 (c)(1),
(2) Date: Jan. 26, 2018

(87) PCT Pub. No.: WO2017/016433
PCT Pub. Date: Feb. 2, 2017

(65) Prior Publication Data

US 2018/0226211 A1 Aug. 9, 2018

(30) Foreign Application Priority Data

Jul. 28, 2015 (CN) ..... 2015 1 0447517

(51) Int. Cl.
*H01H 13/86* (2006.01)
*H01H 13/7065* (2006.01)
*H01H 3/12* (2006.01)

(52) U.S. Cl.
CPC ..... *H01H 13/86* (2013.01); *H01H 13/7065* (2013.01); *H01H 3/125* (2013.01); *H01H 2221/026* (2013.01); *H01H 2221/058* (2013.01)

(58) Field of Classification Search
CPC .... H01H 13/86; H01H 13/7065; H01H 3/125; H01H 2221/058; H01H 2221/026
(Continued)

(56) References Cited

U.S. PATENT DOCUMENTS

2012/0048700 A1* 3/2012 Liu ..... H01H 3/125 200/5 A
2013/0140162 A1 6/2013 Lu
2014/0367240 A1* 12/2014 Lin ..... H01H 3/125 200/5 A

FOREIGN PATENT DOCUMENTS

CN 101794674 8/2010
CN 204088137 1/2015
(Continued)

OTHER PUBLICATIONS

Written Opinion and International Search Report for International application No. PCT/CN2016/090862; dated Oct. 7, 2016; 10 pages (English and Chinese).

*Primary Examiner* — Edwin A. Leon
*Assistant Examiner* — Lheiren Mae A Caroc
(74) *Attorney, Agent, or Firm* — Rankin, Hill & Clark LLP

(57) ABSTRACT

A keyboard switch includes a base, a static contact, a movable contact, an upper cover, a button and a reset spring; the upper cover is buckled to the base; one end of the button is install on the base and the other end passes through the upper cover; the upper and lower ends of the reset spring respectively abut against the button and the base; at least two balance bars for preventing the button from tilting; at least four rotating grooves and guiding grooves for installing the balancing levers are further included; the body of the balance levers are rotatablely rotatably embedded in the rotation grooves, and both ends of the balancing lever are
(Continued)

rotatablely rotatably embedded in the corresponding guiding grooves and move back and forth along the guiding grooves.

9 Claims, 13 Drawing Sheets

(58) Field of Classification Search
USPC ..... 200/344
See application file for complete search history.

(56) References Cited

FOREIGN PATENT DOCUMENTS

| | | |
|---|---|---|
| CN | 105023789 | 11/2015 |
| CN | 205050739 | 2/2016 |

* cited by examiner

KEYBOARD SWITCH

FIELD OF THE PRESENT APPLICATION

The application is related to the field of keyboard switch, and more particularly to a new keyboard switch.

BACKGROUND OF THE PRESENT APPLICATION

A keyboard switch refers to a switch applied to and mounted on a keyboard. The keyboard switch basically includes a base, an upper cover, a static contact, a moving contact, and a button. The upper cover and the base form a containing chamber, in which the static contact, the moving contact and the button are arranged, one end of the button protruding from the containing chamber. When the button is pressed, it moves up and down, which button leads the moving contact to be contacted or disconnected with the static contact, thereby turning on and off the keyboard.

For most of traditional keyboard switches, internal periphery of the button is protruded downwards to form a positioning post that may expand and contract at an opening of the base for triggering junctions of the circuit. Contacting surface between the positioning post and the base is small, and the button is liable to tilt or be stuck in the process of pressing down the button. On one hand, the button would probably be stuck, which makes the operation inconvenient and unstable; on the other hand, sense of touch is not satisfying and incapable of fulfilling user's need.

In order to solve the problems, the guiding tube and the keyboard post extending into the keyboard hole of the prior art are generally designed to be with relatively large contacting surface, such that the button is capable of moving axially inside the keyboard hole of the guiding tube. However, on one hand, since a contacting surface between the button and the guiding tube exists, a relatively high friction exists between the button and the guiding tube, which is laborious; on the other hand, smoothness is not satisfying during operation, and the operation is complicated because of the overly simple structure.

SUMMARY

In order to solve the problems above, a new keyboard switch that may prevent the button from tilting or being stuck, save labor while operation with smoothness, good sense of touch and easy installation is provided.

Technical solutions provided by the application are as follows: a new keyboard switch includes a base, a static contact, a moving contact, an upper cover, a button configured to control the moving contact to move such that the moving contact is contacted with the static contact, and a reset spring for restoring the button to its original position; the upper cover is buckled on the base, both the static contact and the moving contact being disposed on the base; one end of the button is installed on the base and is capable of moving upwards and downwards, the other end thereof passing through the upper cover; upper and lower ends of the reset spring abut against the button and the base respectively; the keyboard switch further includes at least two balancing levers for preventing the button from tilting and at least four rotating grooves and guiding grooves for installing the balancing levers, the number of the rotating grooves and the guiding grooves being twice of the number of the balancing lever; bodies of the balancing levers are capable of being embedded in the rotating grooves rotatably, and both ends of the balancing levers are capable of being embedded in corresponding guiding grooves rotatably and moving forwards and backwards along the guiding grooves.

As an improvement to the above technical solutions, two of the balancing levers are provided, which are a first balancing lever and a second lever, in which the first balancing lever and the second balancing lever are arranged between the button and the base symmetrically, two first rotating grooves and two second rotating grooves being respectively arranged on two sides of the base, two first guiding grooves and two second guiding grooves being respectively arranged on two opposite sides of the button; the first (second) balancing lever includes a first (second) lever body and two first (second) extension arms; the two first (second) extension arms are bent integrally and extended from two ends of the first (second) lever body respectively; both bottom ends of the two first (second) extension arms are bent to form two first (second) connecting arms which are opposite to each other; the first (second) lever body is capable of being embedded in the first (second) rotating groove rotatably, and the two first (second) connecting arms are respectively capable of being embedded in corresponding first (second) guiding grooves rotatably and moving forwards and backwards along the first (second) guiding grooves; two first (second) rotating grooves are respectively arranged side by side spaced with intervals; two ends of the first (second) lever body are respectively embedded in the first (second) rotating grooves.

As an improvement to the above technical solutions, middle parts of the first guiding grooves and the second guiding grooves are provided with a positioning part extending towards the base, while the base is provided with a positioning hole correspondingly, the positioning part being embedded in the positioning hole.

As an improvement to the above technical solutions, two of the balancing levers are provided, which are a third balancing lever and a fourth lever, in which the third balancing lever and the fourth balancing lever are arranged symmetrically on outer sides of the upper cover and the button; two third rotating grooves and two fourth rotating grooves are respectively arranged on two opposite sides of the upper cover; two third guiding grooves and two fourth guiding grooves are respectively arranged on two opposite sides of the button; The third (fourth) balancing lever includes a third (fourth) lever body and two third (fourth) extension arms, the two third (fourth) extension arms being bent integrally and extended from two ends of the third (fourth) lever body respectively, both bottom ends of the two third (fourth) extension arms being bent to form two third (fourth) connecting arms which are opposite to each other; the third (fourth) lever body is capable of being embedded in the third (fourth) rotating grooves rotatably, and the two third (fourth) connecting arms are respectively capable of being embedded in corresponding third (fourth) guiding grooves rotatably and moving forwards and backwards along the third (fourth) guiding grooves; two third (fourth) rotating grooves are respectively arranged side by side spaced with intervals; two ends of the third (fourth) lever body are respectively embedded in the third (fourth) rotating grooves.

As an improvement to the above technical solutions, an external fixing plate for fixing the base is installed beneath the base, wherein two of the balancing levers are provided, which are a fifth balancing lever and a sixth balancing lever, in which the fifth balancing lever and the sixth balancing lever being symmetrically arranged on outer sides of the external fixing plate and the button, an installing hole being arranged for the base is located at the center of the external fixing plate; two supporting seats are symmetrically arranged on two sides of the installing hole, two fifth rotating grooves and two sixth rotating grooves being respectively arranged on the two supporting seats; two fifth guiding grooves and two sixth guiding grooves are respectively arranged on two opposite sides of the button; the fifth (sixth) balancing lever includes a fifth (sixth) lever body, two fifth (sixth) supporting arms and two fifth (sixth) extension arms; the two fifth (sixth) supporting arms are bent and extended upwards from two ends of the fifth (sixth) lever body respectively; the two fifth (sixth) extension arms are bent integrally and extended from bottom ends of the fifth (sixth) supporting arms, both bottom ends of the two fifth (sixth) extension arms being bent and extended to form two fifth (sixth) connecting arms which are opposite to each other; the fifth (sixth) lever body is capable of being embedded in the fifth (sixth) rotating grooves rotatably, and the two fifth (sixth) connecting arms are respectively capable of being embedded in corresponding fifth (sixth) guiding grooves rotatably and moving forwards and backwards along the fifth (sixth) guiding grooves; two fifth (sixth) rotating grooves are respectively arranged side by side spaced with intervals; two ends of the fifth (sixth) lever body are respectively embedded in the fifth (sixth) rotating grooves.

As an improvement to the above technical solutions, wherein two of the balancing levers are provided, which are a seventh balancing lever and an eighth balancing lever, in which the seventh balancing lever and the eighth balancing lever are symmetrically arranged on outer sides of the upper cover and the base; two seventh rotating grooves and two eighth rotating grooves are respectively arranged on two opposite sides of the base; groove covers configured to cover the seventh rotating grooves and the eighth rotating grooves are arranged at positions of two opposite sides of the upper cover corresponding to the seventh rotating grooves and the eighth rotating grooves; two seventh guiding grooves and two eighth guiding grooves are respectively arranged on two opposite sides of the button; the seventh (eighth) balancing lever includes a seventh (eighth) lever body, two seventh (eighth) supporting arms and two seventh (eighth) extension arms; the two seventh (eighth) supporting arms are bent and extended upwards from two ends of the seventh (eighth) lever body respectively; the two seventh (eighth) extension arms are bent integrally and extended from bottom ends of the seventh (eighth) supporting arms, both bottom ends of the two seventh (eighth) extension arms being bent and extended to form two seventh (eighth) connecting arms which are opposite to each other; the seventh (eighth) lever body is capable of being embedded in the seventh (eighth) rotating grooves rotatably, and the two seventh (eighth) connecting arms are respectively capable of being embedded in corresponding seventh (eighth) guiding grooves rotatably and moving forwards and backwards along the seventh (eighth) guiding grooves; two seventh (eighth) rotating grooves are respectively arranged side by side spaced with intervals; two ends of the seventh (eighth) lever body are respectively embedded in the seventh (eighth) rotating grooves.

As an improvement to the above technical solutions, each of the two opposite sides of the upper cover is provided with two sprockets spaced with intervals, positions of two opposite sides of the base corresponding to those between the two sprockets protruded outwards with bulges; the sprockets are buckled on both sides of the bulges, and the upper cover and the base are mutually buckled through the sprockets.

As an improvement to the above technical solutions, the upper cover and the base are buckled to form a first containing chamber and a second containing chamber; the static contact and the moving contact are located in the first containing chamber, while the button and the reset spring are located in the second containing chamber; the first balancing lever and the second balancing lever are located in the second containing chamber.

As an improvement to the above technical solutions, the button is provided with a guiding hole; correspondingly, the base is provided with a guiding post, the guiding post being located inside the guiding hole, which guiding post moves upwards and downwards along the guiding hole.

As an improvement to the above technical solutions, the static contact is provided with a static contact point and a first welding pin, while the moving contact is provided with a moving contact point and a second welding pin, the static contact point and the moving contact point being arranged correspondingly, the first welding pin and the second welding pin being both extended beyond the base.

Beneficial effects of the present application include:

1, At least two balancing levers are arranged between the button and the base, or installed outside between the upper cover and the base, or outside between the upper cover and the button, or outside between the external fixing plate and the button; the button may be positioned in place via the balancing levers, such that in the process of pressing down the button, the button would not tilt or be stuck, thereby ensuring convenient and smooth operation with good sense of touch, simple structure and easy installation.

2, Since two balancing levers are symmetrically arranged on two sides of the button, when a user presses down the button from a tilt angle, rotation of the balancing levers can offset pressing force distribution in the tilting direction, thus further preventing the button from tilting or being stuck to ensure smooth operation.

3, The two balancing levers can be rotated and installed on both sides of the button movably back and forth through two connecting arms, and rotatabely installed on the base, external fixing plate or upper cover through two lever bodies; frictions force among the balancing levers, and the base, external fixing plate and the upper cover is low, which avoids the button from tilting, and makes the operation of the keyboard switch more labor-saving and smoother.

4, The upper cover is provided with sprockets spaced with intervals, corresponding positions of the base are provided with bulges; the sprockets are buckled on both sides of the bulges, and the upper cover and the base are mutually buckled through the sprockets; the upper cover and the base are coupled tightly thanks to the mutual buckling, which avoids the button from loosing, tilting or being stuck.

5, The upper cover and the base are buckled to form a first containing chamber and a second containing chamber; the button is located in the second containing chamber; the first balancing lever and the second balancing lever are also located in the second containing chamber; the contact area between the button and the base is small; on the premise that the first balancing lever and the second balancing lever cooperate to ensure that the button will not tilt, there will be lower friction force in case of upward and downward moving of the button, which is labor saving.

6, Middle parts of the first guiding groove and the second guiding groove of the button are provided with a positioning part, while the base is provided with a positioning hole correspondingly; the positioning part is embedded in the positioning hole to position the button from both sides, so as to further prevent the button from tilting or being stuck during upward and downward movement, which ensures smoothness for operation.

7, The button is provided with a guiding hole; correspondingly, the base is provided with a guiding post located inside the guiding hole, which guiding post moves upwards and downwards along the guiding post; the button is capable of being positioned fixedly in horizontal plane and moving axially because of that the guiding post is located inside the guiding hole, which further prevents the button from tilting or being stuck during upward and downward movement, ensuring smoothness for operation.

DETAILED DESCRIPTION OF THE PREFERRED EMBODIMENT

Figure 1:
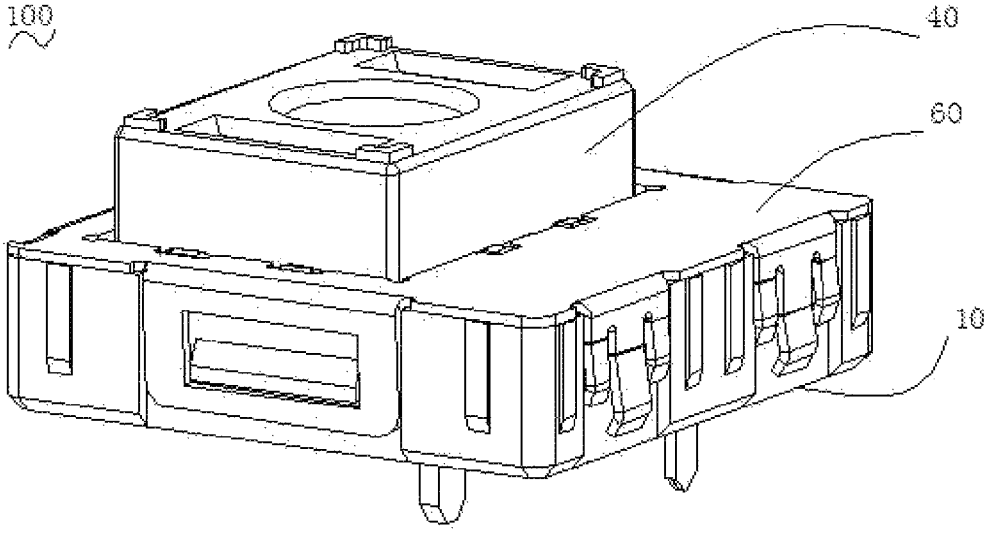
FIG. 1 is a perspective view according to a first embodiment of the present application.
Figure 2:
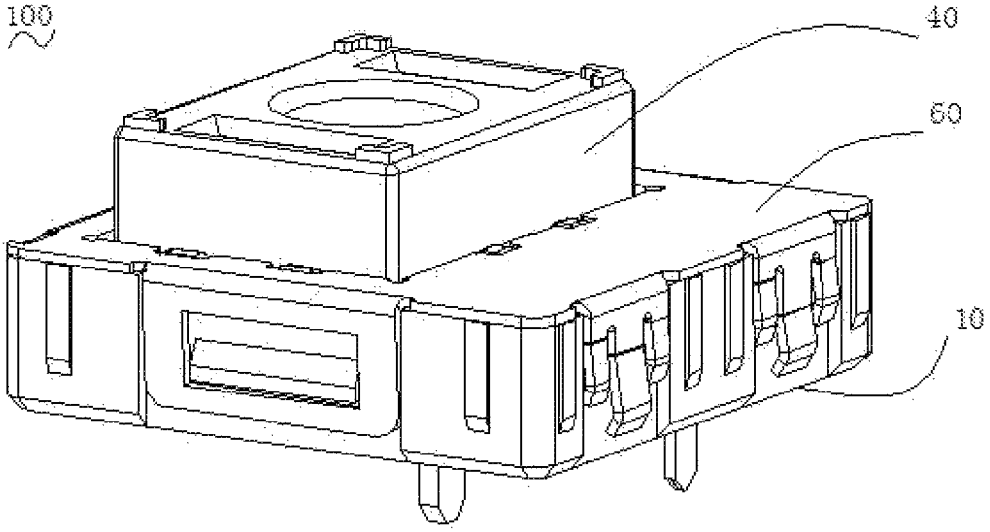
FIG. 2 is a breakdown view according to the first embodiment of the present application.
Figure 3:
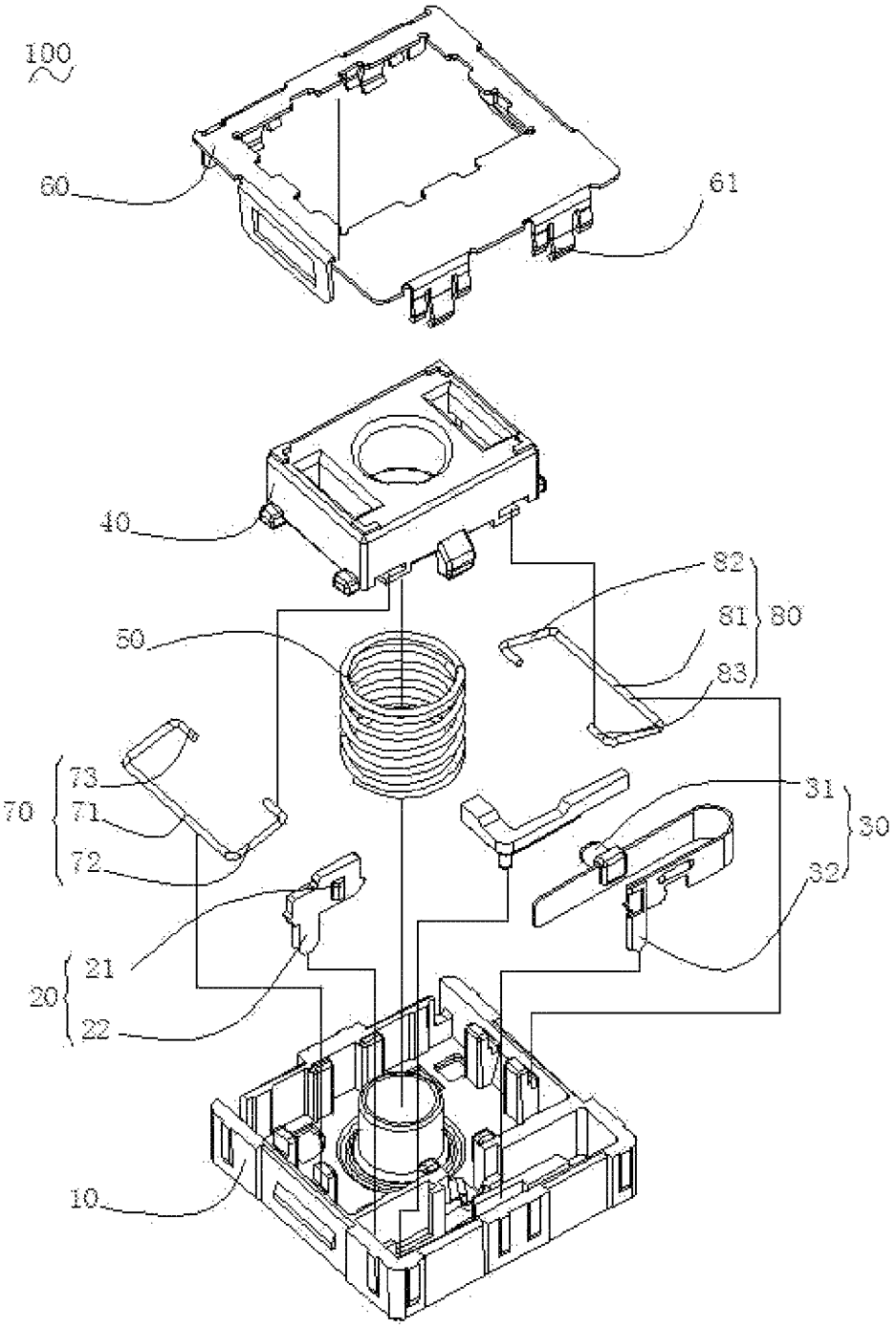
FIG. 3 is an explosive view according to the first embodiment of the present application.
Figure 4:
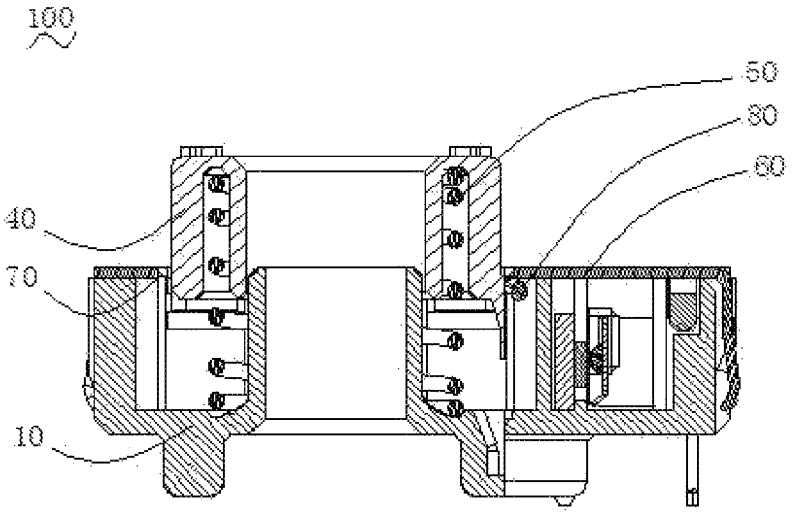
FIG. 4 is a sectional view according to the first embodiment of the present application.

The present application will be further described with reference to the drawings.

First Embodiment

FIGS. 1-4 respectively show a perspective view, a breakdown view, an explosive view and a sectional view of a keyboard switch according to the first embodiment of the present application. The keyboard switch 100 includes a base 10, a static contact 20, a moving contact 30, an upper cover 60, a button 40 configured to control the moving contact 30 to move such that the moving contact 30 can be contacted with the static contact 20, and a reset spring 50 for restoring the button 40 to its original position.

The upper cover 60 is buckled on the base 10, and both the static contact 20 and the moving contact 30 are disposed on the base 10. One end of the button 40 is installed on the base 10 and is capable of moving upwards and downwards, the other end thereof passing through the upper cover 60. Upper and lower ends of the reset spring 50 abut against the button 40 and the base 10 respectively.

The static contact 20 is provided with a static contact point 21 and a first welding pin 22, while the moving contact 30 is provided with a moving contact point 31 and a second welding pin 32. The static contact point 21 and the moving contact point 31 are arranged correspondingly, and the first welding pin 22 and the second welding pin 32 are both extended beyond the base 10.

Figure 5:
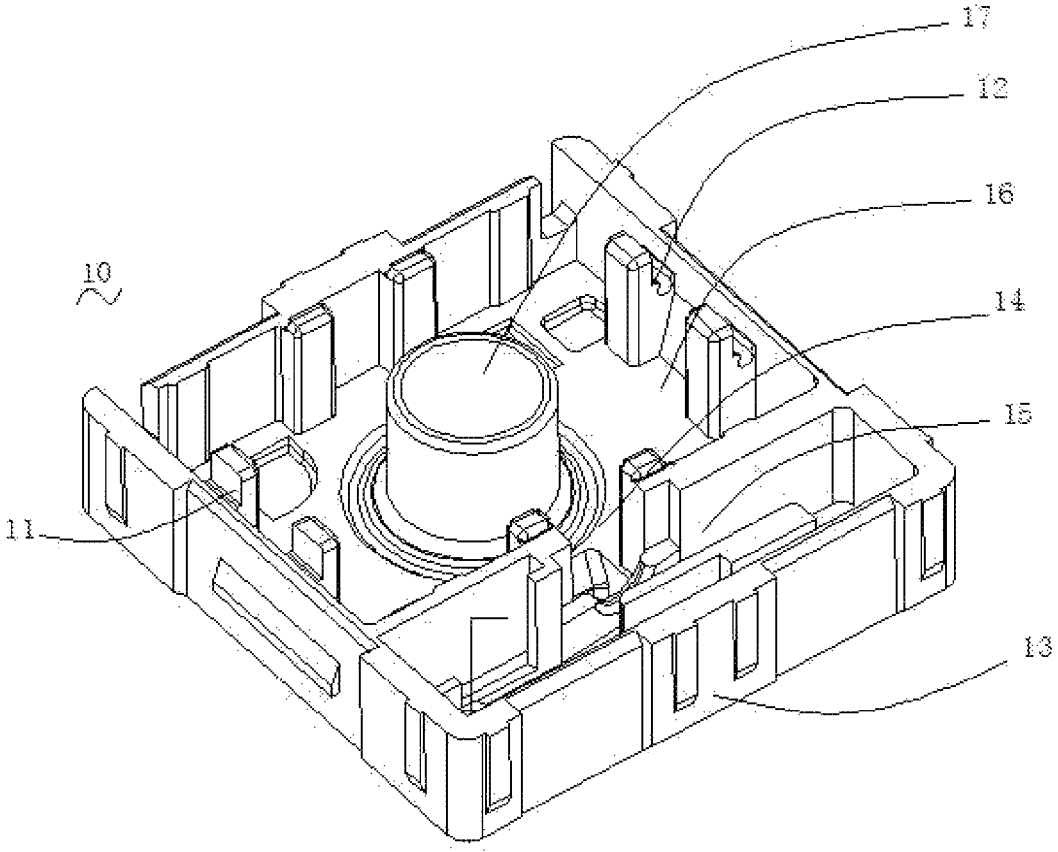
FIG. 5 is a structural view of a base according to the present application.
Figure 6:
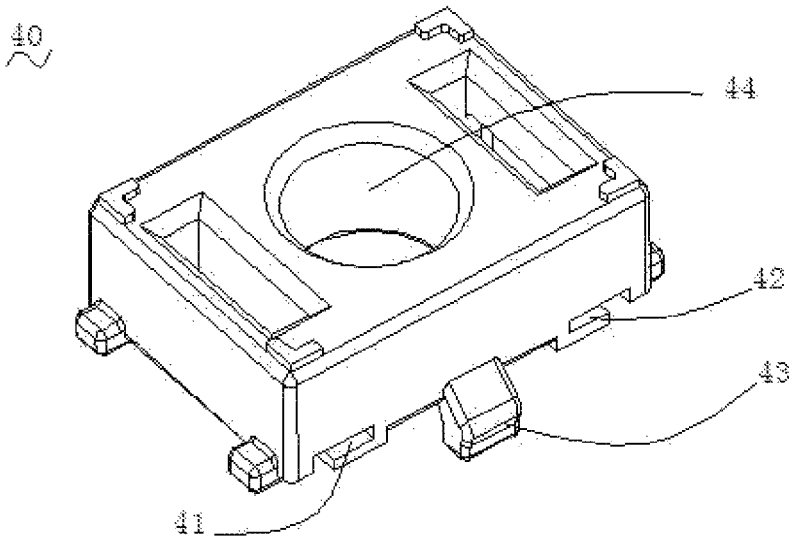
FIG. 6 is a structural view of a button according to the present application.
Figure 7:
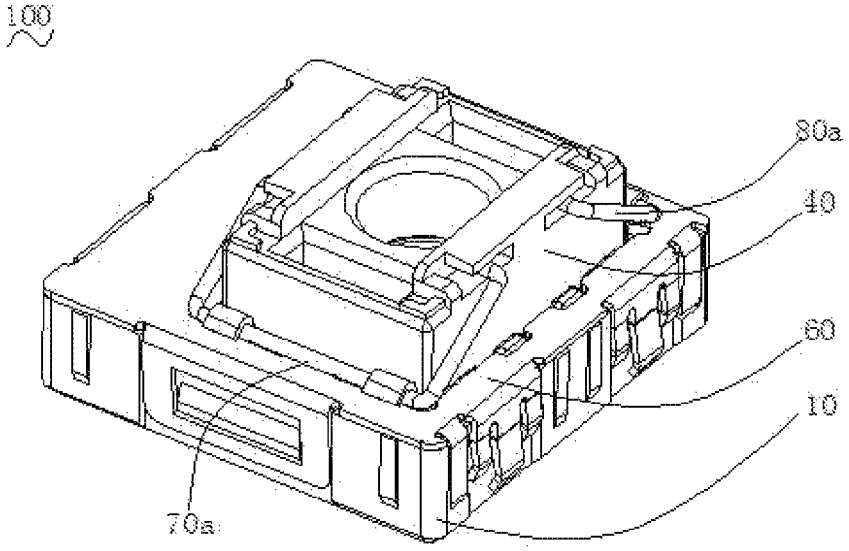
FIG. 7 is a perspective view according to a second embodiment of the present application.
Figure 8:
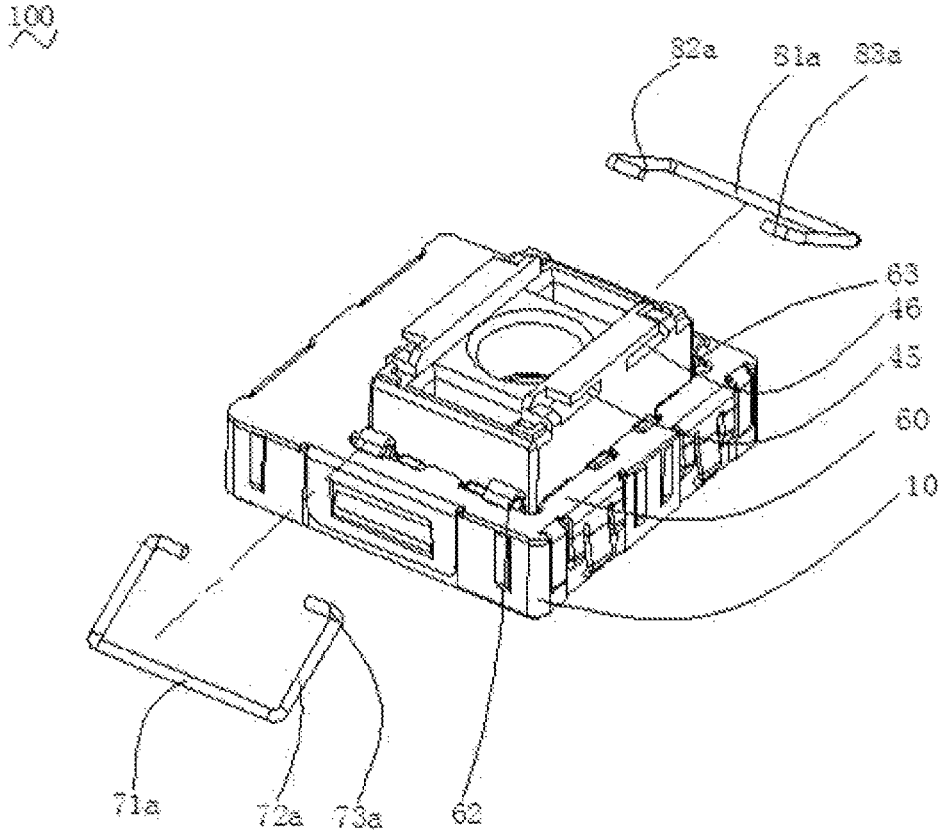
FIG. 8 is a breakdown view according to the second embodiment of the present application.
Figure 9:
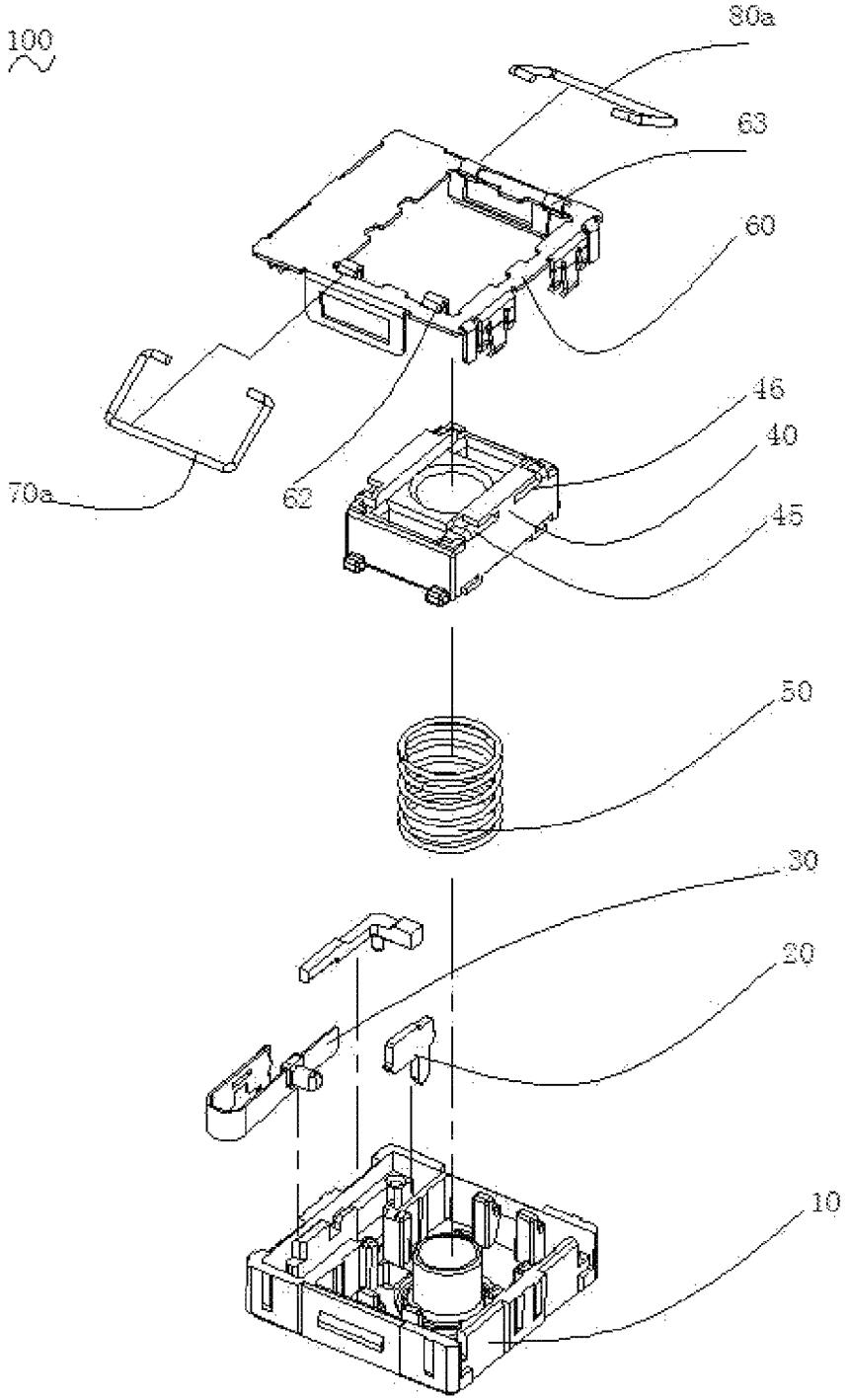
FIG. 9 is an explosive view according to the second embodiment of the present application.
Figure 10:
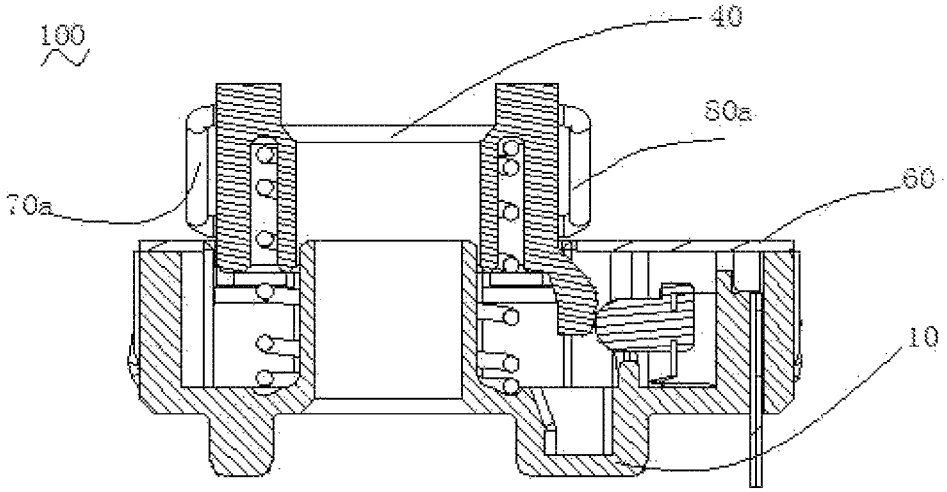
FIG. 10 is a sectional view according to the second embodiment of the present application.
Figure 11:
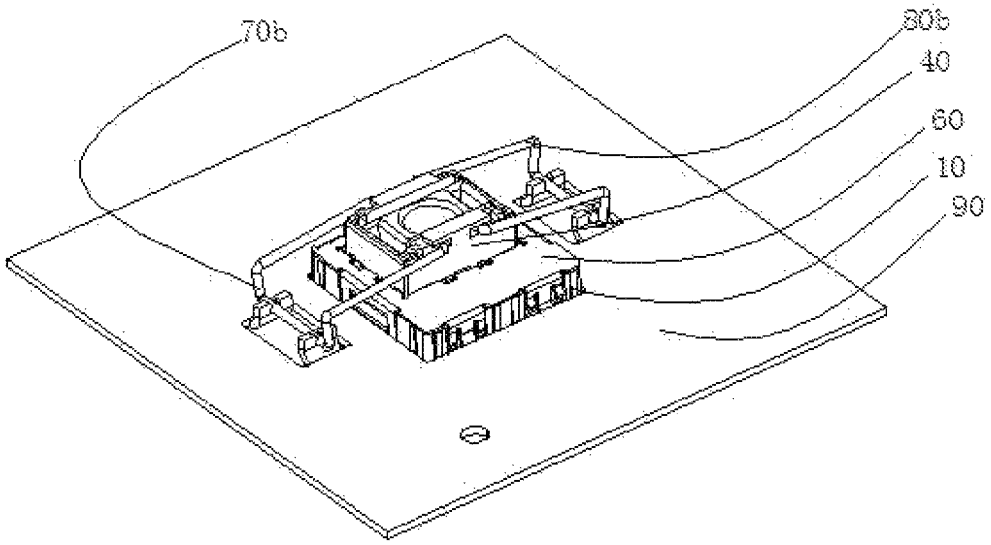
FIG. 11 is a perspective view according to a third embodiment of the present application.
Figure 12:
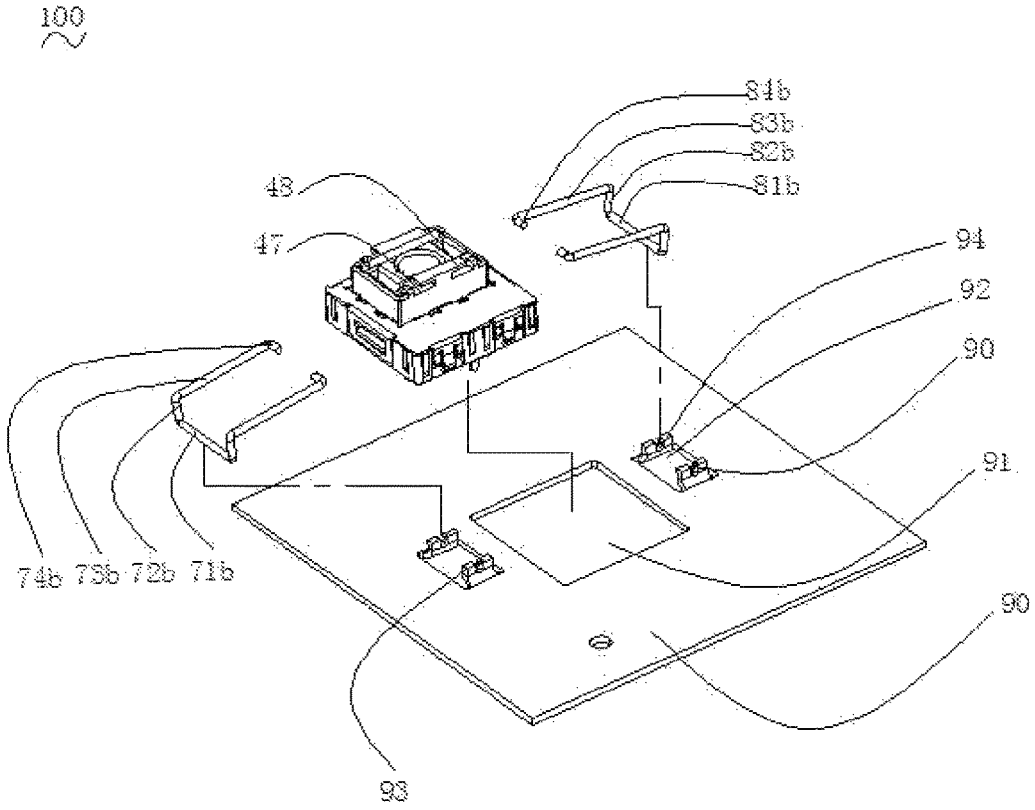
FIG. 12 is a breakdown view according to the third embodiment of the present application.
Figure 13:
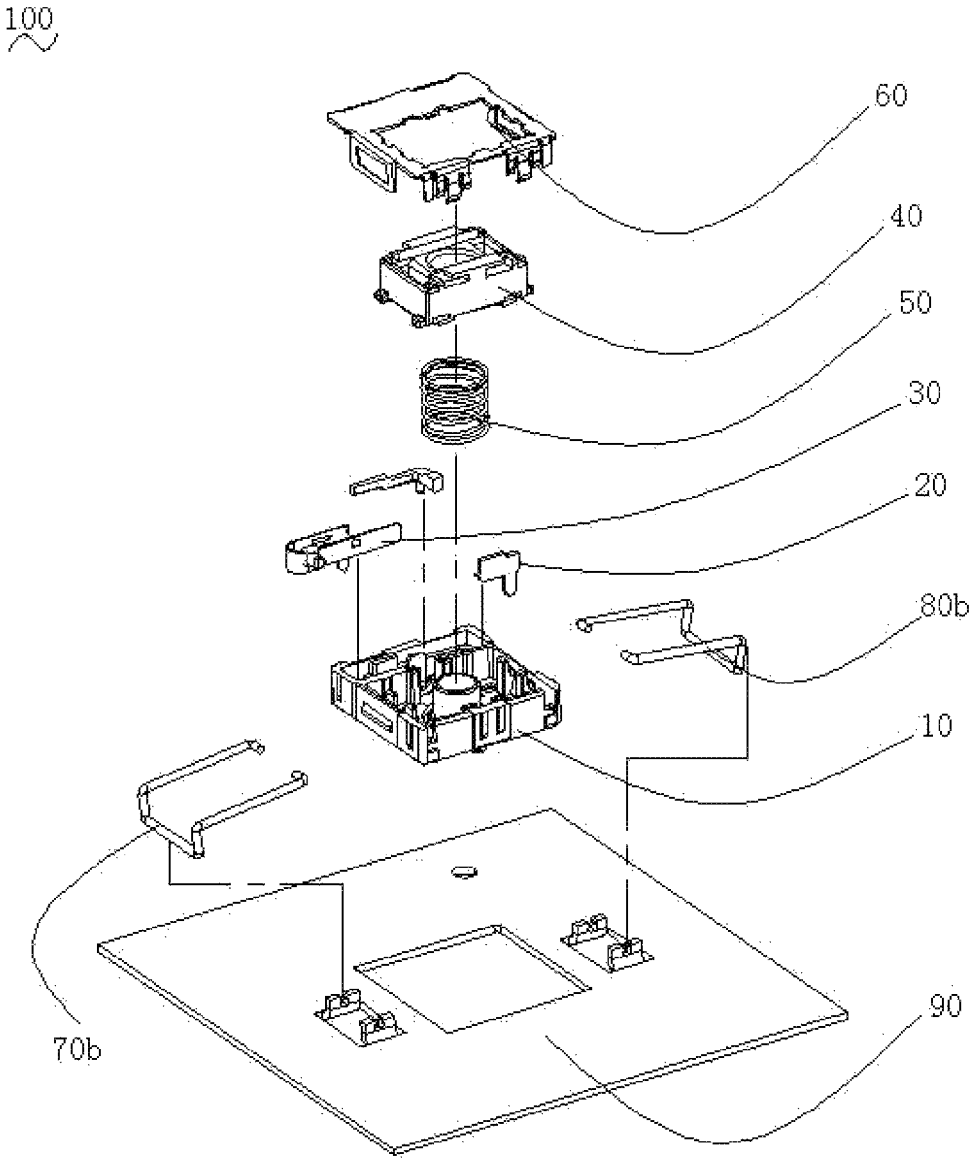
FIG. 13 is an explosive view according to the third embodiment of the present application.
Figure 14:
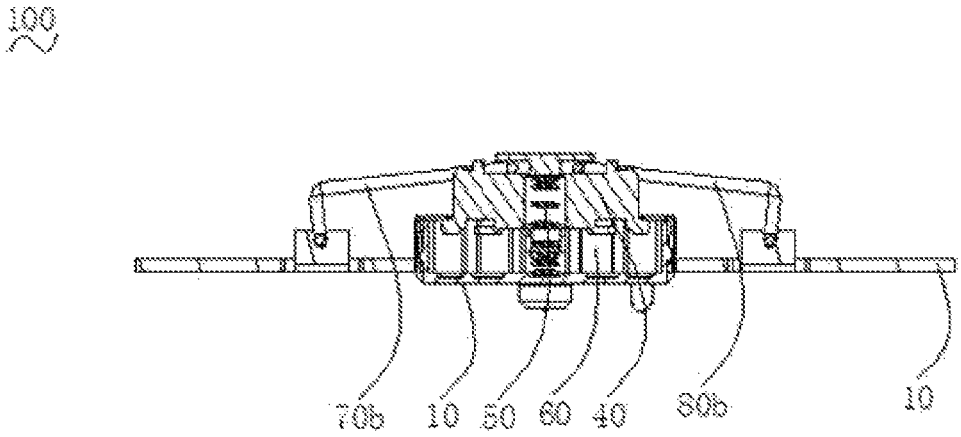
FIG. 14 is a sectional view according to the third embodiment of the present application.

FIGS. 5-6 are respectively structural views of the base and the button according to the first embodiment of the present application. A first balancing lever 70 and a second balancing lever 80 configured to prevent the button 40 from tilting are arranged between the base 10 and the button 40 symmetrically. A first rotating groove 11 and a second rotating groove 12 are respectively arranged on two sides of the base 10. A first guiding groove 41 and a second guiding groove 42 are respectively arranged on two opposite sides of the button 40. The first balancing lever 70 and the second balancing lever 80 are respectively embedded rotatably in the first rotating groove 11 and the second rotating groove 12, and corresponding first guiding groove 41 and second guiding groove 42, and move backwards and forwards along the first guiding groove 41 and the second guiding groove 42.

Since the first balancing lever 70 and the second balancing lever 80 configured to prevent the button 40 from tilting are arranged between the base 10 and the button 40 symmetrically, the two balancing levers are capable of positioning the button 40 in position. Therefore, in the process of pressing downing the button 40, the button 40 would not tilt or be stuck, thus ensuring that the switch 100 is labor saving, convenient and smooth to operate with good sense of touch.

Since the first balancing lever 70 and the second balancing lever 80 are symmetrically arranged on both sides of the button 40, when a user presses down the button 40 from a tilt angle, rotation of the first and second balancing levers can offset pressing force distribution in the tilting direction, thus further preventing the button 40 from tilting or being stuck to ensure smooth operation.

The first balancing lever 70 includes a first lever body 71 and two first extension arms 72; the two first extension arms 72 are bent integrally and extended from two ends of the first lever body 71 respectively; both bottom ends of the two first extension arms 72 are bent to form two first connecting arms 73 which are opposite to each other. The first lever body 71 is capable of being embedded in the first rotating groove 11 rotatably, and the two first connecting arms 73 are respectively capable of being embedded in corresponding first guiding groove 41 rotatably and moving forwards and backwards along the first guiding groove 41. The second balancing lever 80 includes a second lever body 81 and two second extension arms 82; the two second extension arms 82 are bent integrally and extended from two ends of the second lever body 81 respectively; both bottom ends of the two second extension arms 82 are bent to form two second connecting arms 83 which are opposite to each other. The second lever body 81 is capable of being embedded in the first rotating groove 12 rotatably, and the two second connecting arms 83 are respectively capable of being embedded in corresponding second guiding groove 42 rotatably and moving forwards and backwards along the second guiding groove 42.

The first balancing lever 70 and the second balancing lever 80 can be rotated and installed on both sides of the button 40 movably back and forth through the first connecting arm 73 and the second connecting arm 83, and rotatabely installed on the base 10 through the first lever body 71 and the second lever body 81. Friction force among the first balancing lever 70 and the second balancing lever 80, and the base 10 and the button 40 is low, which avoids the button 40 from tilting, and makes the operation of the keyboard switch 100 more labor-saving and smoother.

Two first rotating grooves 11 and two second rotating grooves 12 are respectively arranged side by side spaced with intervals; two ends of the first lever body 71 and two ends of the second lever body 81 are respectively embedded in the first rotating grooves 11 and the second rotating grooves 12.

Each of the two opposite sides of the upper cover 60 is provided with two sprockets 61 spaced with intervals, positions of two opposite sides of the base 10 corresponding to those between the two sprockets protruded outwards with bulges 111. The sprockets 61 can be buckled on both sides of the bulge 13, and the upper cover 60 and the base 10 are mutually buckled through the sprockets 61 and the bulge 13. The upper cover 60 and the base 10 are coupled tightly thanks to the mutual buckling, which avoids the button 40 from loosing, tilting or being stuck.

The upper cover 60 and the base 10 are buckled to form a first containing chamber 15 and a second containing chamber 16; the static contact 20 and the moving contact 30 are located in the first containing chamber 15, while the button 40 and the reset spring 50 are located in the second containing chamber 16; the first balancing lever 70 and the second balancing lever 80 are located in the second containing chamber 16. The contact area between the button 40 and the base 10 is small. On the premise that the first balancing lever 70 and the second balancing lever 80 cooperate to ensure that the button 40 will not tilt, there will be lower friction force in case of upward and downward moving of the button 40, which is labor saving.

Middle parts of the first guiding groove 41 and the second guiding groove 42 of the button 40 are provided with a positioning part 43 extending towards the base 10, while the base 10 is provided with a positioning hole correspondingly. The positioning part 43 is embedded in the positioning hole 14 to position the button 40 from both sides, so as to further prevent the button 40 from tilting or being stuck during upward and downward movement, which ensures smoothness for operation.

The button 40 is provided with a guiding hole 44; correspondingly, the base 10 is provided with a guiding post 17. The guiding post 17 is located inside the guiding hole 44, which guiding post 17 moves upwards and downwards along the guiding hole 44. The button 40 is capable of being positioned fixedly in horizontal plane and moving axially because of that the guiding post 17 is located inside the guiding hole 44, which further prevents the button 40 from tilting or being stuck during upward and downward movement, ensuring smoothness for operation.

Working principle of the application is as follows:

During the assembly procedure, at first, the static contact 20 and the moving contact 30 are both installed on the base 10, such that the first welding pin 22 of the static contact 20 and the second welding pin 32 of the moving contact 30 both extend downwards beyond the base 10; secondly, the reset spring 50 is abutted against below the guiding hole 44 of the button 40, which guiding hole 44 is capable of containing the guiding post 17 and moving upwards and downwards, at the same time, the reset spring 50 also coats the guiding post 17, and lower end of the reset spring 50 is embedded in the base 10. The positioning part 43 of the button 40 is also movably embedded in the positioning hole 14 of the base, such that one end of the button 40 can be arranged on the base, and capable of moving upwards and downwards; furthermore, the first connecting arm 73 of the first balancing lever 70 and the second connecting arm 83 of the second balancing lever 80 are respectively rotatabely embedded into corresponding first guiding groove 41 and second guiding groove 42, and the first lever body 71 and the second lever body 81 are then rotatabely embedded into the first rotating groove 11 and the second rotating groove 12; at last, the upper cover 60 is arranged such that the sprockets 61 and the bulges 13 are buckled, the upper cover 60 is installed on and fixed on the base 10, and the other end of the button 40 passes through the upper cover 60.

Working principle for preventing the button 40 from tilting is as follows. In an original state, the button 40 is abutted against the moving contact 30 such that the moving contact point 31 of the moving contact 30 is detached from the static contact point 21 of the static contact 20, and the circuit is then in a disconnected state.

When the button 40 is under stress, the button 40 may move downwards and be detached away from the moving contact 30. Under the elasticity of the moving contact 30, the moving contact 30 may extend such that the moving contact point 31 and the static contact point 21 may contact with each other, thereby turning on the circuit. Under the action of the button 40, the first lever body 71 of the first balancing lever 70 and the second lever body 81 of the second balancing lever 80 may rotate, in which the first connecting arm 73 may move rightwards while rotating, while the second connecting arm 83 may move leftwards while rotating.

When the stress is gone, under the action of the reset spring 50, the button 40 may move upwards to its original position automatically, such that the button 40 may be abutted against the moving contact 30 again, the moving contact point 31 being detached away from the static contact point 21 such that the circuit is turned off. The first lever body 71 and the second lever body 81 rotates reversely, in which the first connecting arm 73 moves leftwards to its original position while rotating reversely, while the second connecting arm 83 moves rightwards to its original position while rotating reversely.

The two balancing levers are capable of positioning the button 40 in position while the button 40 is moving downwards under stress, therefore, in the process of pressing downing the button 40, the button 40 would not tilt or be stuck, thus ensuring that the process of pressing down the keyboard switch 100 is labor saving, convenient and smooth to operate with good sense of touch. At the same time, the button 40 is capable of being positioned fixedly in horizontal plane because the guiding post 17 is located inside the guiding hole 44, and moving axially from both sides because the positioning part 43 is located inside the positioning hole 41, which further prevents the button 40 from tilting or being stuck during upward and downward movement, ensuring smoothness for operation.

In the present embodiment, two balancing levers are provided. In alternative embodiments, more than two balancing levers may be provided.

Second Embodiment

FIGS. 7-10 respectively show a perspective view, a breakdown view, an explosive view and a sectional view of a keyboard switch according to the second embodiment of the present application.

Specific structure of the keyboard switch in the embodiment is basically identical to that in the first embodiment, difference being that in the embodiment, a third balancing lever 70*a* and a fourth balancing lever 80*a* arranged symmetrically on outer sides of the upper cover 60 and the button 40. Two third rotating grooves 62 and two fourth rotating grooves 63 are respectively arranged on two opposite sides of the upper cover 60. Two third guiding grooves 45 and two fourth guiding grooves 46 are respectively arranged on two opposite sides of the button 40. The third balancing lever 70*a* includes a third lever body 71*a* and two third extension arms 72*a*; the two third extension arms 72*a* are bent integrally and extended from two ends of the third lever body 71*a* respectively; both bottom ends of the two third extension arms 72*a* are bent to form two third connecting arms 73*a* which are opposite to each other. The third lever body 71*a* is capable of being embedded in the third rotating grooves 62 rotatably, and the two third connecting arms 73*a* are respectively capable of being embedded in corresponding third guiding grooves 45 rotatably and moving forwards and backwards along the third guiding grooves 45. The fourth balancing lever 80*a* includes a fourth lever body 81*a* and two fourth extension arms 82*a*; the two fourth extension arms 82*a* are bent integrally and extended from two ends of the fourth lever body 81*a* respectively; both bottom ends of the two fourth extension arms 82*a* are bent to form two fourth connecting arms 83*a* which are opposite to each other. The fourth lever body 81*a* is capable of being embedded in the fourth rotating grooves 63 rotatably, and the two fourth connecting arms 83*a* are respectively capable of being embedded in corresponding fourth guiding grooves 46 rotatably and moving forwards and backwards along the fourth guiding grooves 46. Two third rotating grooves 62 and two fourth rotating grooves 63 are respectively arranged side by side spaced with intervals; two ends of the third lever body 71*a* and two ends of the fourth lever body 81*a* are respectively embedded in the third rotating grooves 62 and the fourth rotating grooves 63.

Third Embodiment

FIGS. 11-14 respectively show a perspective view, a breakdown view, an explosive view and a sectional view of a keyboard switch according to the third embodiment of the present application.

Specific structure of the keyboard switch in the embodiment is basically identical to that in the first embodiment, difference being that in the embodiment, an external fixing plate 90 for fixing the base is installed beneath the base, a fifth balancing lever 70*b* and a sixth balancing lever 80*b* being symmetrically arranged on outer sides of the external fixing plate 90 and the button 40, an installing hole 91 being arranged for the base is located at the center of the external fixing plate 90. Two supporting seats 92 are symmetrically arranged on two sides of the installing hole 91, two fifth rotating grooves 93 and two sixth rotating grooves 94 being respectively arranged on the two supporting seats 92. Two fifth guiding grooves 47 and two sixth guiding grooves 48 are respectively arranged on two opposite sides of the button 40. The fifth balancing lever 70*b* includes a fifth lever body 71*b*, two fifth supporting arms 72*b* and two fifth extension arms 73*b*; the two fifth supporting arms 72*b* are bent and extended upwards from two ends of the fifth lever body 71*b* respectively; the two fifth extension arms 73*b* are bent integrally and extended from bottom ends of the fifth supporting arms 72*b*, both bottom ends of the two fifth extension arms 73*b* are bent and extended to form two fifth connecting arms 74*b* which are opposite to each other. The fifth lever body 71*b* is capable of being embedded in the fifth rotating grooves 93 rotatably, and the two fifth connecting arms 74*b* are respectively capable of being embedded in corresponding fifth guiding grooves 47 rotatably and moving forwards and backwards along the fifth guiding grooves 47. The sixth balancing lever 80*b* includes a sixth lever body 81*b*, two sixth supporting arms 82*b* and two sixth extension arms 83*b*; the two sixth supporting arms 82*b* are bent and extended upwards from two ends of the sixth lever body 81*b* respectively; the two sixth extension arms 83*b* are bent integrally and extended from bottom ends of the sixth supporting arms 82*b*, both bottom ends of the two sixth extension arms 83*b* are bent and extended to form two sixth connecting arms 84*b* which are opposite to each other. The sixth lever body 81*b* is capable of being embedded in the sixth rotating grooves 94 rotatably, and the two sixth connecting arms 84*b* are respectively capable of being embedded in corresponding sixth guiding grooves 48 rotatably and moving forwards and backwards along the sixth guiding grooves 48. Two fifth rotating grooves 93 and two sixth rotating grooves 94 are respectively arranged side by side spaced with intervals; two ends of the fifth lever body 71*b* and two ends of the sixth lever body 81*b* are respectively embedded in the fifth rotating grooves 93 and the sixth rotating grooves 94.

Fourth Embodiment

Figure 15:
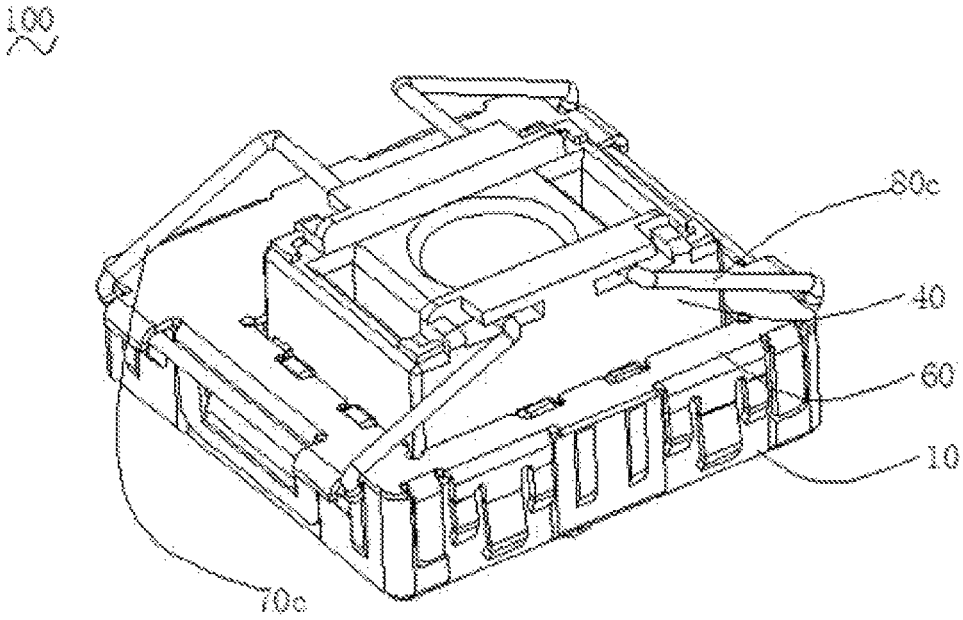
FIG. 15 is a perspective view according to a fourth embodiment of the present application.
Figure 16:
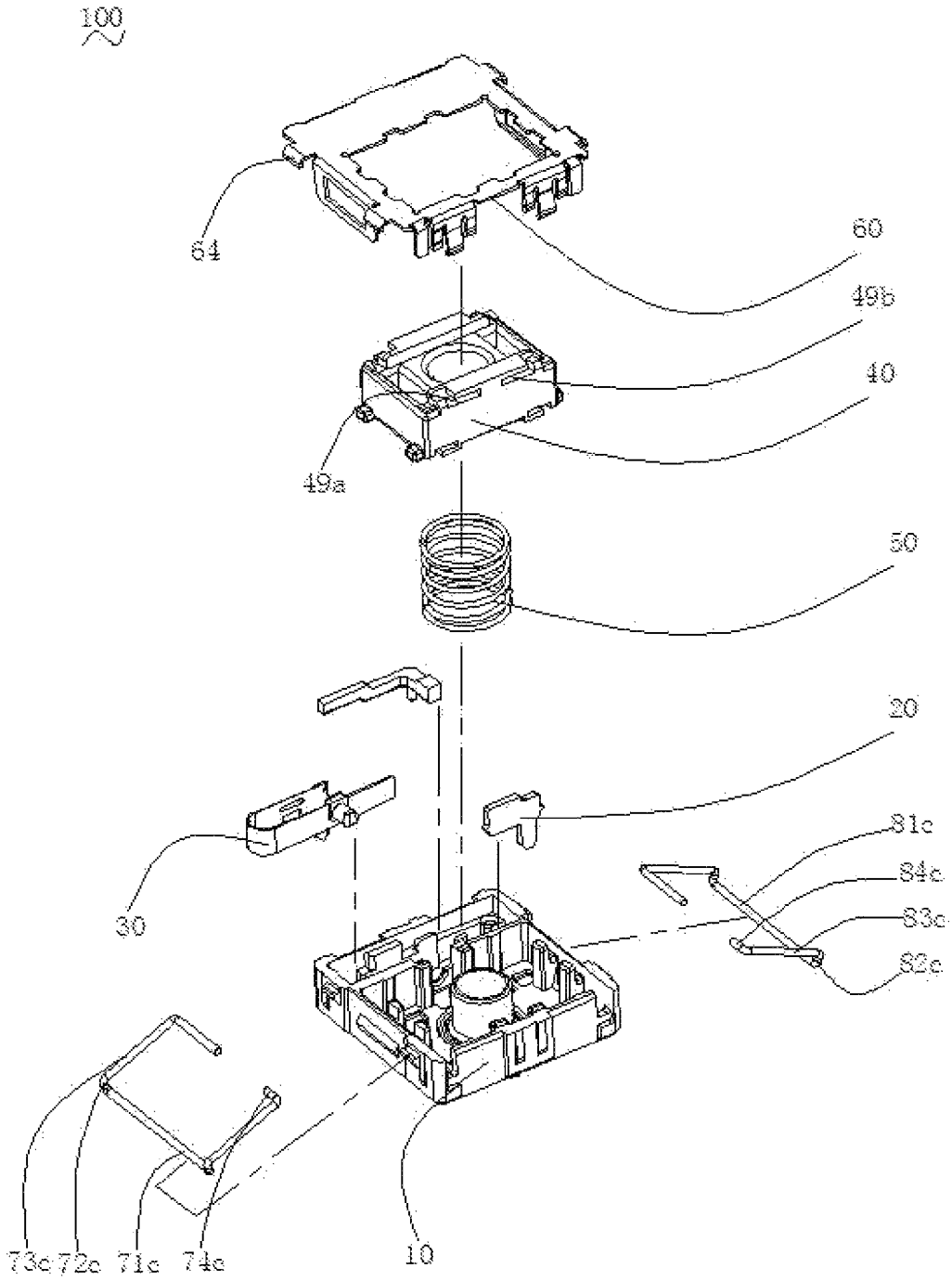
FIG. 16 is an explosive view according to the fourth embodiment of the present application.
Figure 17:
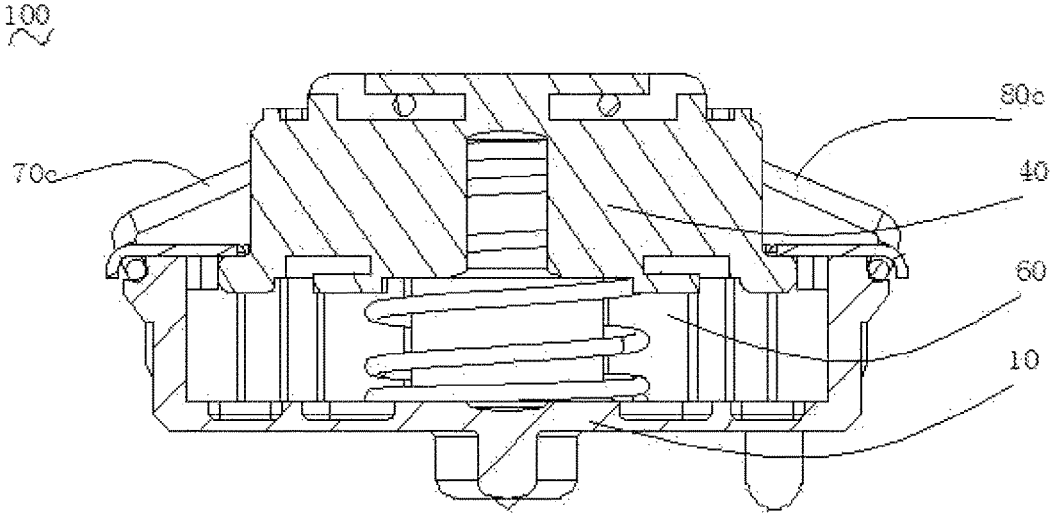
FIG. 17 is a sectional view according to the fourth embodiment of the present application.

FIGS. 15-17 respectively show a perspective view, a breakdown view, an explosive view and a sectional view of a keyboard switch according to the fourth embodiment of the present application.

Specific structure of the keyboard switch in the embodiment is basically identical to that in the first embodiment, difference being that in the embodiment, a seventh balancing lever 70*c* and an eighth balancing lever 80*c* are symmetrically arranged on outer sides of the upper cover 60 and the base 10.

Two seventh rotating grooves 15 and two eighth rotating grooves 16 are respectively arranged on two opposite sides of the base 10. Groove covers 64 configured to cover the seventh rotating grooves 15 and the eighth rotating grooves 16 are arranged at positions of two opposite sides of the upper cover corresponding to the seventh rotating grooves 15 and the eighth rotating grooves 16. Two seventh guiding grooves 49*a* and two eighth guiding grooves 49*b* are respectively arranged on two opposite sides of the button 40. The seventh balancing lever 70*c* includes a seventh lever body 71*c*, two seventh supporting arms 72*c* and two seventh extension arms 73*c*; the two seventh supporting arms 72*c* are bent and extended upwards from two ends of the seventh lever body 71*c* respectively; the two seventh extension arms 73*c* are bent integrally and extended from bottom ends of the seventh supporting arms 72*c*, both bottom ends of the two seventh extension arms 73*c* are bent and extended to form two seventh connecting arms 74*c* which are opposite to each other. The seventh lever body 71*c* is capable of being embedded in the seventh rotating grooves 15 rotatably, and the two seventh connecting arms 74*c* are respectively capable of being embedded in corresponding seventh guiding grooves 49*a* rotatably and moving forwards and backwards along the seventh guiding grooves 49*a*. The eighth balancing lever 80*c* includes an eighth lever body 81*c*, two eighth supporting arms 82*c* and two eighth extension arms 83*c*; the two eighth supporting arms 82*c* are bent and extended upwards from two ends of the eighth lever body 81*c* respectively; the two eighth extension arms 83*c* are bent integrally and extended from bottom ends of the eighth supporting arms 82*c*, both bottom ends of the two eighth extension arms 83*c* are bent and extended to form two eighth connecting arms 84*b* which are opposite to each other. The eighth lever body 81*c* is capable of being embedded in the eighth rotating grooves 16 rotatably, and the two eighth connecting arms 84*c* are respectively capable of being embedded in corresponding eighth guiding grooves 49*b* rotatably and moving forwards and backwards along the eighth guiding grooves 49*b*. Two seventh rotating grooves 15 and two eighth rotating grooves 16 are respectively arranged side by side spaced with intervals; two ends of the seventh lever body 71*c* and two ends of the eighth lever body 81*c* are respectively embedded in the seventh rotating grooves 15 and the eighth rotating grooves 16.

The embodiments described above, which are specific and detailed, are merely illustration of the present application, but not intended to limit protection scope of the present application. It should be noted that alternatives and improvements made by those skilled in the art without departing from the principle of the present application shall fall in the protection scope of the present application. Therefore, the protection scope of the present application should be subject to the appended claims.

What is claimed is:

1. A new keyboard switch, comprising:

a base;

a static contact;

a moving contact;

an upper cover;

a button for controlling the moving contact to move such that the moving contact is contacted with the static contact; and a reset spring for restoring the button to its original position;

wherein the upper cover is buckled on the base, both the static contact and the moving contact being disposed on the base; one end of the button is installed on the base and is capable of moving upwards and downwards, the other end of the button passing through the upper cover; upper and lower ends of the reset spring abut against the button and the base respectively;

wherein the keyboard switch further comprises, at least two balancing levers for preventing the button from tilting; and at least four rotating grooves and guiding grooves for installing the balancing levers, the number of the rotating grooves and the guiding grooves being twice of the number of the balancing levers; bodies of the balancing levers are capable of being embedded in the rotating grooves rotatably, and both ends of the balancing levers are capable of being embedded in corresponding guiding grooves rotatably and moving forwards and backwards along the guiding grooves;

and wherein middle parts of the first guiding grooves and the second guiding grooves are provided with a positioning part extending towards the base, while the base is provided with a positioning hole correspondingly, the positioning part being embedded in the positioning hole.

2. The new keyboard switch of claim 1, wherein two of the balancing levers are provided, which are a first balancing lever and a second balancing lever, in which the first balancing lever and the second balancing lever are arranged between the button and the base symmetrically, two first rotating grooves and two second rotating grooves being respectively arranged on two sides of the base, two first guiding grooves and two second guiding grooves being respectively arranged on two opposite sides of the button; the first balancing lever includes a first lever body and two first extension arms; the two first extension arms are bent integrally and extend from two ends of the first lever body respectively; both bottom ends of the two first extension arms are bent to form two first connecting arms which are opposite to each other; the first lever body is capable of being embedded in the first rotating groove rotatably, and the two first connecting arms are respectively capable of being embedded in corresponding first guiding grooves rotatably and moving forwards and backwards along the first guiding grooves; two first rotating grooves are respectively arranged side by side spaced with intervals; two ends of the first lever body are respectively embedded in the first rotating grooves; the second balancing lever includes a second lever body and two second extension arms; the two second extension arms are bent integrally and extend from two ends of the second lever body respectively; both bottom ends of the two second extension arms are bent to form two second connecting arms which are opposite to each other; the second lever body is capable of being embedded in the second rotating groove rotatably, and the two second connecting arms are respectively capable of being embedded in corresponding second guiding grooves rotatably and moving forwards and backwards along the second guiding grooves; two second rotating grooves are respectively arranged side by side spaced with intervals; two ends of the second lever body are respectively embedded in the second rotating grooves.

3. The new keyboard switch of claim 1, wherein two of the balancing levers are provided, which are a third balancing lever and a fourth balancing lever, in which the third balancing lever and the fourth balancing lever are arranged symmetrically on outer sides of the upper cover and the button; two third rotating grooves and two fourth rotating grooves are respectively arranged on two opposite sides of the upper cover; two third guiding grooves and two fourth guiding grooves are respectively arranged on two opposite sides of the button; the third balancing lever includes a third lever body and two third extension arms, the two third extension arms being bent integrally and extend from two ends of the third lever body respectively, both bottom ends of the two third extension arms being bent to form two third connecting arms which are opposite to each other; the third lever body is capable of being embedded in the third rotating grooves rotatably, and the two third connecting arms are respectively capable of being embedded in corresponding third guiding grooves rotatably and moving forwards and backwards along the third guiding grooves; two third rotating grooves are respectively arranged side by side spaced with intervals; two ends of the third lever body are respectively embedded in the third rotating grooves; the fourth balancing lever includes a fourth lever body and two fourth extension arms, the two fourth extension arms being bent integrally and extend from two ends of the fourth lever body respectively, both bottom ends of the two fourth extension arms being bent to form two fourth connecting arms which are opposite to each other; the fourth lever body is capable of being embedded in the fourth rotating grooves rotatably, and the two fourth connecting arms are respectively capable of being embedded in corresponding fourth guiding grooves rotatably and moving forwards and backwards along the fourth guiding grooves; two fourth rotating grooves are respectively arranged side by side spaced with intervals; two ends of the fourth lever body are respectively embedded in the fourth rotating grooves.

4. The new keyboard switch of claim 1, wherein an external fixing plate for fixing the base is installed beneath the base, in which two of the balancing levers are provided, which are a fifth balancing lever and a sixth balancing lever, the fifth balancing lever and the sixth balancing lever being symmetrically arranged on outer sides of the external fixing plate and the button, an installing hole being arranged for the base is located at the center of the external fixing plate; two supporting seats are symmetrically arranged on two sides of the installing hole, two fifth rotating grooves and two sixth rotating grooves being respectively arranged on the two supporting seats; two fifth guiding grooves and two sixth guiding grooves are respectively arranged on two opposite sides of the button; the fifth balancing lever includes a fifth lever body, two fifth supporting arms and two fifth extension arms; the two fifth supporting arms are bent and extend upwards from two ends of the fifth lever body respectively; the two fifth extension arms are bent integrally and extend from bottom ends of the fifth supporting arms, both bottom ends of the two fifth extension arms being bent and extended to form two fifth connecting arms which are opposite to each other; the fifth lever body is capable of being embedded in the fifth rotating grooves rotatably, and the two fifth connecting arms are respectively capable of being embedded in corresponding fifth guiding grooves rotatably and moving forwards and backwards along the fifth guiding grooves; two fifth rotating grooves are respectively arranged side by side spaced with intervals; two ends of the fifth lever body are respectively embedded in the fifth rotating grooves; the sixth balancing lever includes a sixth lever body, two sixth supporting arms and two sixth extension arms; the two sixth supporting arms are bent and extend upwards from two ends of the sixth lever body respectively; the two sixth extension arms are bent integrally and extend from bottom ends of the sixth supporting arms, both bottom ends of the two sixth extension arms being bent and extended to form two sixth connecting arms which are opposite to each other; the sixth lever body is capable of being embedded in the sixth rotating grooves rotatably, and the two sixth connecting arms are respectively capable of being embedded in corresponding sixth guiding grooves rotatably and moving forwards and backwards along the sixth guiding grooves; two sixth rotating grooves are respectively arranged side by side spaced with intervals; two ends of the sixth lever body are respectively embedded in the sixth rotating grooves.

5. The new keyboard switch of claim 1, wherein two of the balancing levers are provided, which are a seventh balancing lever and an eighth balancing lever, in which the seventh balancing lever and the eighth balancing lever are symmetrically arranged on outer sides of the upper cover and the base; two seventh rotating grooves and two eighth rotating grooves are respectively arranged on two opposite sides of the base; groove covers configured to cover the seventh rotating grooves and the eighth rotating grooves are arranged at positions of two opposite sides of the upper cover corresponding to the seventh rotating grooves and the eighth rotating grooves; two seventh guiding grooves and two eighth guiding grooves are respectively arranged on two opposite sides of the button; the seventh balancing lever includes a seventh lever body, two seventh supporting arms and two seventh extension arms; the two seventh supporting arms are bent and extend upwards from two ends of the seventh lever body respectively; the two seventh extension arms are bent integrally and extended from bottom ends of the seventh supporting arms, both bottom ends of the two seventh extension arms being bent and extended to form two seventh connecting arms which are opposite to each other; the seventh lever body is capable of being embedded in the seventh rotating grooves rotatably, and the two seventh connecting arms are respectively capable of being embedded in corresponding seventh guiding grooves rotatably and moving forwards and backwards along the seventh guiding grooves; two seventh rotating grooves are respectively arranged side by side spaced with intervals; two ends of the seventh lever body are respectively embedded in the seventh rotating grooves; the eighth balancing lever includes an eighth lever body, two eighth supporting arms and two eighth extension arms; the two eighth supporting arms are bent and extend upwards from two ends of the eighth lever body respectively; the two eighth extension arms are bent integrally and extend from bottom ends of the eighth supporting arms, both bottom ends of the two eighth extension arms being bent and extended to form two eighth connecting arms which are opposite to each other; the eighth lever body is capable of being embedded in the eighth rotating grooves rotatably, and the two eighth connecting arms are respectively capable of being embedded in corresponding eighth guiding grooves rotatably and moving forwards and backwards along the eighth guiding grooves; two eighth rotating grooves are respectively arranged side by side spaced with intervals; two ends of the eighth lever body are respectively embedded in the eighth rotating grooves.

6. The new keyboard switch of claim 1, wherein each of the two opposite sides of the upper cover is provided with two sprockets spaced with intervals, positions of two opposite sides of the base corresponding to those between the two sprockets protruded outwards with bulges; the sprockets are buckled on both sides of the bulges, and the upper cover and the base are mutually buckled through the sprockets.

7. The new keyboard switch of claim 6, wherein the upper cover and the base are buckled to form a first containing chamber and a second containing chamber; the static contact and the moving contact are located in the first containing chamber, while the button and the reset spring are located in the second containing chamber; the first balancing lever and the second balancing lever are located in the second containing chamber.

8. The new keyboard switch of claim 7, wherein the button is provided with a guiding hole; correspondingly, the base is provided with a guiding post, the guiding post being located inside the guiding hole, which guiding post moves upwards and downwards along the guiding hole.

9. The new keyboard switch of claim 8, wherein the static contact is provided with a static contact point and a first welding pin, while the moving contact is provided with a moving contact point and a second welding pin, the static contact point and the moving contact point being arranged correspondingly, the first welding pin and the second welding pin being both extended beyond the base.

* * * * *